US010814461B2

(12) United States Patent
Doroslovac et al.

(10) Patent No.: US 10,814,461 B2
(45) Date of Patent: Oct. 27, 2020

(54) POWER-DRIVEN DIRECT DRIVE RATCHET/WRENCH TOOL

(71) Applicant: Robert S. Doroslovac, Massillon, OH (US)

(72) Inventors: Robert S. Doroslovac, Massilon, OH (US); Paul Kukucka, Brandon, FL (US); Thomas Stefan Kukucka, Brandon, FL (US)

(73) Assignee: Robert S. Doroslovac, Massillon, OH (US)

( * ) Notice: Subject to any disclaimer, the term of this patent is extended or adjusted under 35 U.S.C. 154(b) by 0 days.

(21) Appl. No.: 16/107,899

(22) Filed: Aug. 21, 2018

(65) Prior Publication Data

US 2018/0354103 A1 Dec. 13, 2018

Related U.S. Application Data

(63) Continuation-in-part of application No. 14/701,482, filed on Apr. 30, 2015, now abandoned, and a (Continued)

(51) Int. Cl.
*B25B 21/00* (2006.01)
*B25F 5/02* (2006.01)
(Continued)

(52) U.S. Cl.
CPC ..... *B25B 21/004* (2013.01); *B25B 13/04* (2013.01); *B25B 13/065* (2013.01); (Continued)

(58) Field of Classification Search
CPC ..... B25B 13/481; B25B 13/465; B25B 17/00; B25B 21/004; B25B 13/46; B25B 13/461; (Continued)

(56) References Cited

U.S. PATENT DOCUMENTS 2,570,706 A * 10/1951 Peluse ..... B25B 23/16 81/57.26
3,972,252 A * 8/1976 Hunter ..... B25B 13/467 81/57.29
(Continued)

OTHER PUBLICATIONS https://www.amazon.com/Performance-Tool-W30645-Magnetic-Ratcheting/dp/B00CES2TL4/ref=sr_1_1?ie=UTF8&qid=1544725390&sr=8-1&keywords=performance+tool+W30645+SAE Performance Tool W30645 SAE Flex Magnetic Ratcheting Wrench (8 piece) Apr. 15, 2013 (Year: 2013).*

*Primary Examiner* — Monica S Carter
*Assistant Examiner* — Abbie E Quann

(57) ABSTRACT

A power driven direct drive ratchet/wrench tool allows a user to tighten and loosen fasteners in tight spaces efficiently and effectively. The tool includes a tool housing, a engagement body, a spur gear, a drive shaft, and a plurality of drive pins. The tool housing acts as the structural element and includes a ratchet head, a tubular handle, and a gear-receiving cavity. The ratchet head is terminally connected to the tubular handle. The gear-receiving cavity laterally traverses into the ratchet head and houses the spur gear and the engagement body. The drive shaft is rotatably mounted within the tubular handle. The plurality of drive pins is connected to a proximal base of the drive shaft, about a rotation axis of the drive shaft. In order to transmit torque, an at least one arbitrary pin from the plurality of drive pins is mechanically engaged to the spur gear.

8 Claims, 4 Drawing Sheets

Related U.S. Application Data continuation-in-part of application No. 15/601,864, filed on May 22, 2017, now abandoned, and a continuation-in-part of application No. PCT/IB2017/052453, filed on Apr. 27, 2017, said application No. 16/107,899 is a continuation-in-part of application No. 29/592,608, filed on Jan. 31, 2017, now abandoned, and a continuation-in-part of application No. 29/604,799, filed on May 19, 2017, now Pat. No. Des. 829,069, and a continuation-in-part of application No. 15/650,768, filed on Jul. 14, 2017, now Pat. No. 10,081,094, and a continuation-in-part of application No. 15/601,864, filed on May 22, 2017, now abandoned, said application No. 16/107,899 is a continuation-in-part of application No. 16/107,842, filed on Aug. 21, 2018.

(60) Provisional application No. 61/986,327, filed on Apr. 30, 2014, provisional application No. 62/328,102, filed on Apr. 27, 2016, provisional application No. 62/475,757, filed on Mar. 23, 2017, provisional application No. 62/451,491, filed on Jan. 27, 2017, provisional application No. 62/459,371, filed on Feb. 15, 2017, provisional application No. 62/482,916, filed on Apr. 7, 2017, provisional application No. 62/531,828, filed on Jul. 12, 2017.

(51) Int. Cl.

| | |
|---|---|
| ***B25F 5/00*** | (2006.01) |
| ***B25B 13/06*** | (2006.01) |
| ***B25B 13/04*** | (2006.01) |
| ***B25B 27/18*** | (2006.01) |
| ***B25B 15/00*** | (2006.01) |

(52) U.S. Cl.

CPC ..... *B25B 15/008* (2013.01); *B25B 27/18* (2013.01); *B25F 5/001* (2013.01); *B25F 5/02* (2013.01)

(58) Field of Classification Search

CPC ... B25B 17/02; B25B 23/141; B25B 23/1427; B25F 5/001; B25F 5/02

USPC ..... 81/58.3

See application file for complete search history.

(56) References Cited

U.S. PATENT DOCUMENTS

| | | | | |
|---|---|---|---|---|
| D776,505 | S | 1/2017 | Doroslovac | |
| 9,687,968 | B2 | 1/2017 | Doroslovac et al. | |
| D784,106 | S | 4/2017 | Doroslovac | |
| D794,405 | S | 8/2017 | Doroslovac et al. | |
| D798,682 | S | 10/2017 | Doroslovac et al. | |
| 2016/0075002 | A1* | 3/2016 | Hu | B25B 13/465 81/57.13 |
| 2018/0236641 | A1* | 8/2018 | Hu | B25B 13/463 |

* cited by examiner

DETAIL A

POWER-DRIVEN DIRECT DRIVE RATCHET/WRENCH TOOL

The current application claims a priority to the U.S. Provisional Patent application Ser. No. 62/328,102 filed on Apr. 27, 2016.

FIELD OF THE INVENTION

The present invention relates generally to power tools, ratchets and wrenches to be specific. In particular, the present invention is a power-driven direct drive ratchet/wrench tool which allows a user to speed up the process of tightening or loosening an external object such as a screw, bold, nut, and other similar fasteners, where space and access to the external object is limited.

BACKGROUND OF THE INVENTION

Traditional wrench-type tools used for tightening and loosening fasteners provide users with a mechanical advantage in order to allow the user to apply a significantly large amount of torque to the fastener. In certain cases, the amount of torque is still insufficient and the user must then turn to powered wrench-type tools. These types of tools are powered by an external source, such as a pneumatic driver, and apply said force onto the fastener. Power driven tools significantly increase the torque provided and the time required to tighten or loosen as fastener. One of the main downsides of power driven tools is their relative size. Because of the machinery and technology required for the operation of these types of tools, the resulting tool is bulky and hard to maneuver, especially in low clearance areas. Therefore, there is a need for a power-driven tool which provides the benefits of power driven tools without the associated large profile.

The objective of the present invention is to create a power-driven tool to speed up the process of twisting, turning or loosening an object, i.e. bolt, screw, nut etc., where direct/frontal access is limited or restricted by other conventional tools. The present invention utilizes a unique drive train which effectively transmits torque onto the fastener and allows for the reduction of the overall profile of the tool.

DETAIL DESCRIPTIONS OF THE INVENTION

All illustrations of the drawings are for the purpose of describing selected versions of the present invention and are not intended to limit the scope of the present invention.

The present invention is an attachment for a power tool. More specifically, the present invention is a direct drive ratchet/wrench tool powered by an external power tool which allows a user to speed up the process of tightening and loosening a fastener, especially if the fastener is in a hard to reach area with little to no clearance. The present invention may be utilized with and by a variety of external power tools including, but not limited to, electric drivers and pneumatic drivers.

Figure 1:
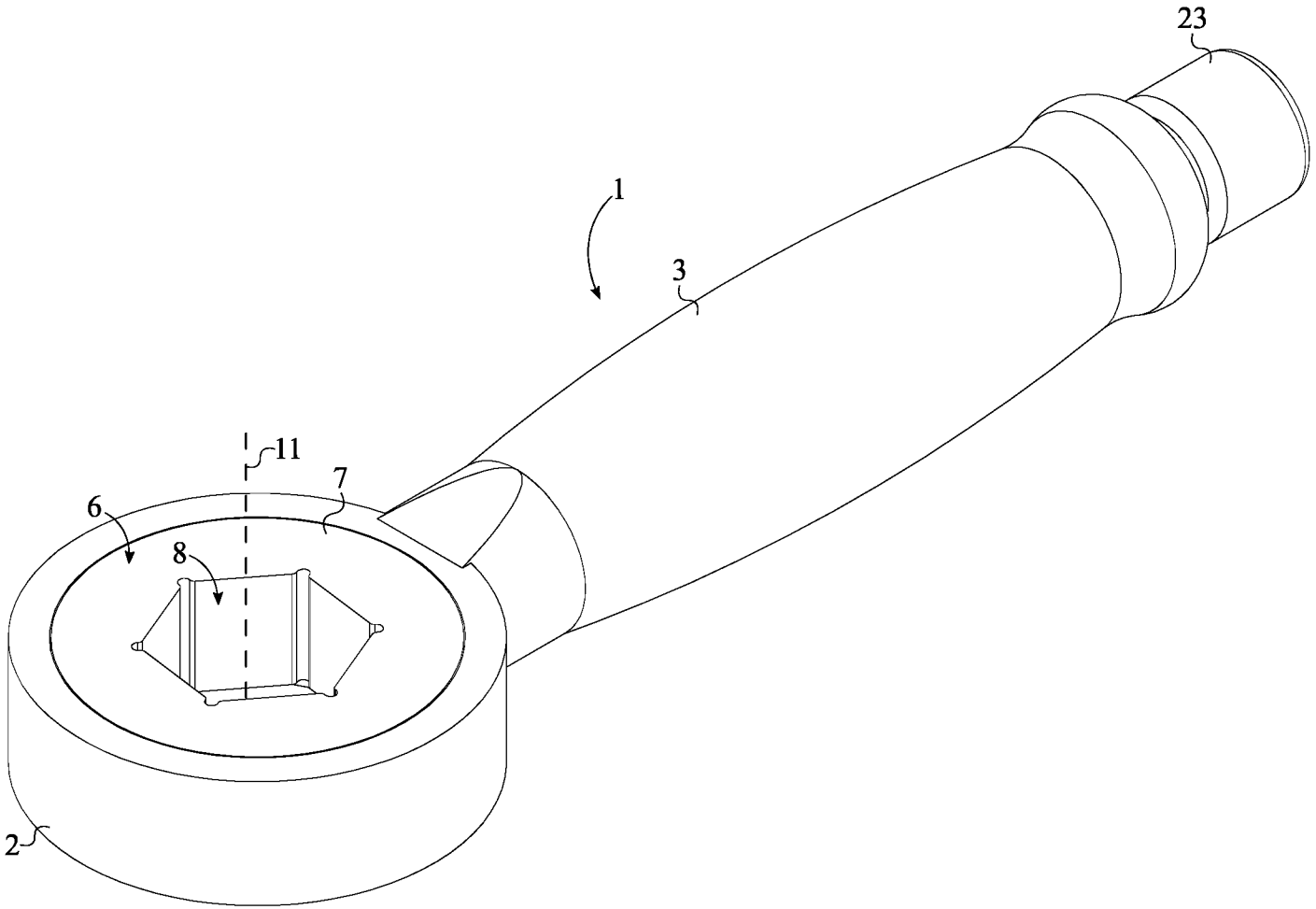
FIG. 1 is a perspective view of the present invention.
Figure 2:
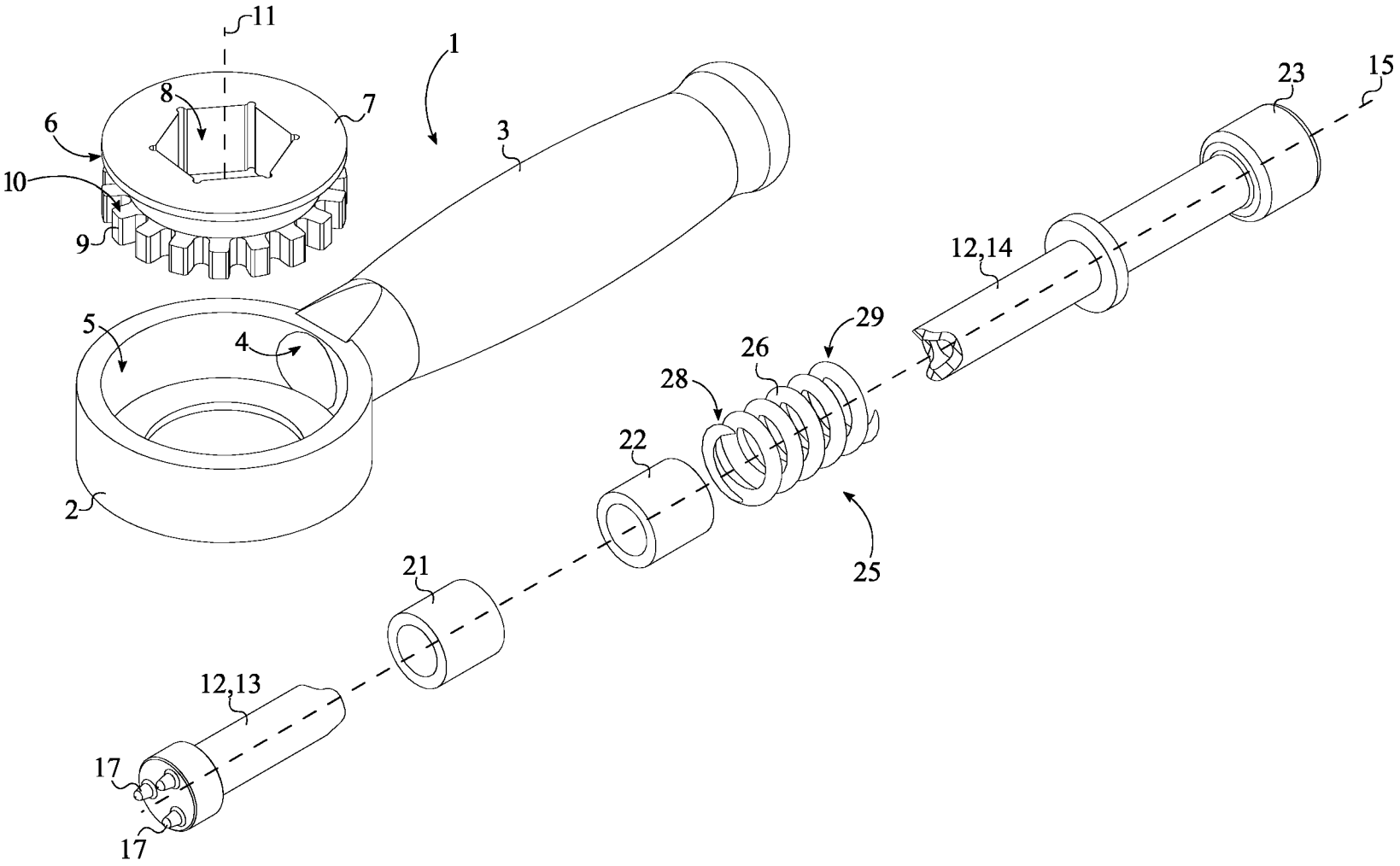
FIG. 2 is an exploded perspective view of the present invention.

Referring to FIG. 1 and FIG. 2, the present invention comprises a tool housing 1, a drive shaft 12, a spur gear 9, a plurality of drive pins 17, and an engagement body 6. The tool housing 1 acts as the structural element of the present invention and comprises a ratchet head 2, a tubular handle 3, and a gear-receiving cavity 5. The ratchet head 2 is a cylindrical housing which encloses and supports the spur gear 9 and the engagement body 6. Similar to traditional wrench designs, the ratchet head 2 is a terminally connected to the tubular handle 3. The gear-receiving cavity 5 laterally traverses into the ratchet head 2 to receive the spur gear 9 and the engagement body 6. More specifically, the gear-receiving cavity 5 intersects a lumen 4 of the tubular handle 3 and is orientated perpendicular to the tubular handle 3. The spur gear 9 transmits torque from the drive shaft 12 to the engagement body 6, which in turn transmits said torque onto an external object such as a bolt, screw, nut, or other similar fastener. As a result, the spur gear 9 is rotatably mounted within the gear-receiving cavity 5; additionally, the spur gear 9 comprises a first face 10. The engagement body 6 acts as the interface element of the present invention to physically engage and apply a torque force onto the external object. The engagement body 6 is adjacently connected to the spur gear 9, opposite the ratchet head 2. More specifically, the engagement body 6 is connected onto the first face 10 of the spur gear 9.

Figure 3:
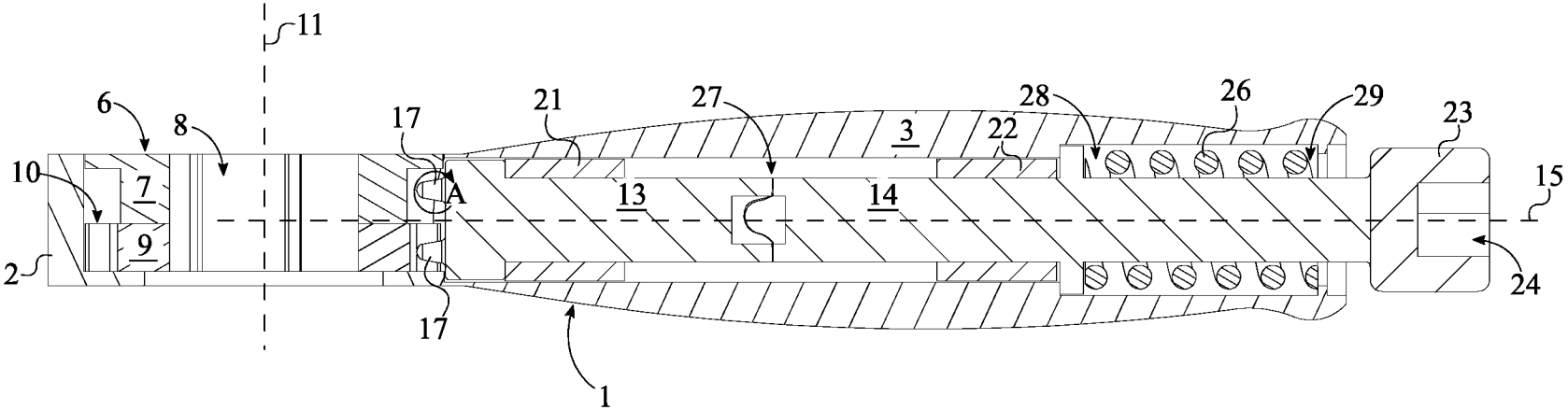
FIG. 3 is a cross-section view of the present invention.

The drive shaft 12 and the plurality of drive pins 17 transfer torque and rotation motion from the external power tool to the spur gear 9. The drive shaft 12 is an elongated cylinder composed of a strong material such as steel. Referring to FIG. 2 and FIG. 3, the drive shaft 12 is concentrically and rotatably mounted within the tubular handle 3. It is preferred that the drive shaft 12 is rotatably mounted within the tubular handle 3 through the use of multiple bearings. The plurality of drive pins 17 engages the spur gear 9 to transfer torque smoothly, contrary to traditional use of offset gears. Because the plurality of drive pins 17 is used, the tool housing 1 and the overall profile of the present invention can be reduced to a considerably slimmer design. For efficient transfer of torque, a rotation axis 11 of the spur gear 9 is oriented perpendicular to a rotation axis 15 of the drive shaft 12. In alternative embodiments of the present invention, the rotation axis 11 of the spur gear 9 may be oriented at an obtuse or an acute angle relative to the rotation axis 15 of the drive shaft 12. To accommodate for this orientation different types of gear designs may be used for the spur gear 9. The plurality of drive pins 17 is radially distributed about the rotation axis 15 of the drive shaft 12 with each of the plurality of drive pins 17 being perpendicularly connected to a proximal base 16 of the drive shaft 12; wherein the proximal base 16 is positioned adjacent to the ratchet head 2. This positions the plurality of drive pins 17 directly next to the spur gear 9. In order to transfer torque, an at least one arbitrary pin from the plurality of drive pins 17 is mechanically engaged to the spur gear 9, wherein the arbitrary pin represents any one from the plurality of drive pins 17. The spur gear 9 in conjunction with the plurality of drive pins 17 produce more torque than traditional off-set gear driven tools.

In one embodiment of the present invention, the drive shaft 12 and the tubular handle 3 are implemented with a flexible joint. The flexible joint allows the user to reach and engage fasteners in difficult to reach areas. The flexible joint may be implemented using a variety of methods including, but not limited to, universal joints, square drive ball joints, hinged joints, and other similar designs.

The plurality of drive pins 17 is able to transfer torque to the spur gear 9 through a continuous partial engagement. In other words, only a certain number from the plurality of drive pins 17 are, at one point, engaged with the spur gear 9. To achieve this, the spur gear 9 must be positioned offset to the plurality of drive pins 17. In particular, the first face 10 of the spur gear 9 is positioned coincident with the rotation axis 15 of the drive shaft 12. As a result, the arbitrary pin, the pin from the plurality of drive pins 17 that is engaged to the spur gear 9, is always traveling with a lateral velocity of the same direction. In other words, the arbitrary pin is located in the lower half of the drive shaft 12, below the rotation axis 15 of the drive shaft 12. This ensures that the lateral force translated from the arbitrary pin to the spur gear 9 is always in the same direction, regardless of the magnitude. This prevents the spur gear 9 from locking up and ensures maximum torque transfer from the drive shaft 12 to the spur gear 9.

In alternative embodiments, the torque transfer between the drive shaft 12 to the engagement body 6 may be achieved through alternative means. In particular, the drive shaft 12 may be mated to the engagement body 6 through the use of different types of gears including, but not limited to, bevel gears, mitre gears, face gears, sprocket gears, skew gears, hypoid gears, and pinion gears to name a few non-limiting examples. Additionally, the drive shaft 12 can be mated to the engagement body 6 by mating various gears in either parallel or perpendicular methods.

Figure 4:
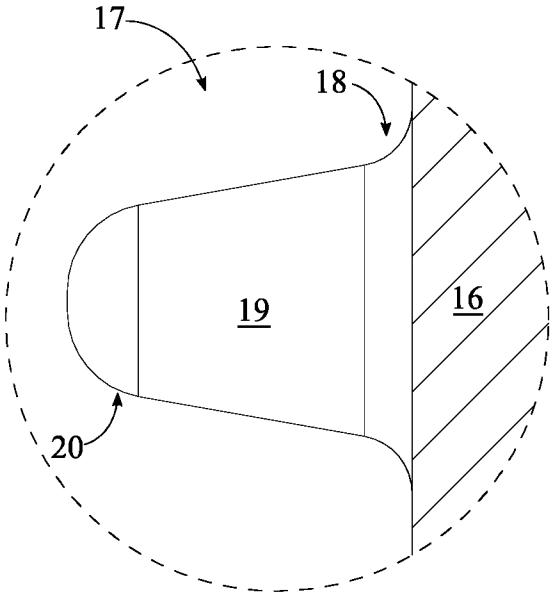
FIG. 4 is a detailed view about circle A-A in FIG. 3.

Referring to FIG. 4, each of the plurality of drive pins 17 comprises a fixed end 18, a tooth body 19, and a free end 20. The fixed end 18 is connected onto the proximal base 16. To ensure a smooth engagement between each of the plurality of drive pins 17 and the teeth of the spur gear 9, the tooth body 19 is tapered from the fixed end 18 to the free end 20. The tapered feature takes into account the fact that the plurality of drive pins 17 is rotating about the rotation axis 15 of the drive shaft 12, which is oriented perpendicular to the rotation axis 11 of the spur gear 9. It is preferred that there are three pins within the plurality of drive pins 17 that are equally distributed about the rotation axis 15 of the drive shaft 12 as seen in FIG. 2. Furthermore, it is preferred that each of the plurality of drive pins 17 is a truncated conical shape. The truncated conical shape compliments the tooth design of the spur gear 9 for efficient and smooth interlocking and transfer of torque. Although, alternative profiles and sizes for each of the plurality of drive pins 17 may be utilized.

In one embodiment of the present invention, referring to FIG. 2, the engagement body 6 acts similar to a wrench socket and comprises a torque-transferring portion 7 and a fastener-receiving cavity 8. This embodiment is designed for bolts, nuts, and other similar fasteners that require a socket to engage the fastener. The torque-transferring portion 7 is a cylindrical extrusion which transfers torque from the spur gear 9 onto the external object. The torque-transferring portion 7 is concentrically and adjacently connected to the spur gear 9, opposite the ratchet head 2. The torque is applied to the external object through the fastener-receiving cavity 8. The fastener-receiving cavity 8 is complimentary shaped to interlock with the external object and laterally traverses through the torque-transferring portion 7 and the spur gear 9. For example, referring to FIG. 2, the fastener-receiving cavity 8 may be hexagonal shaped to engage with traditional hexagonal shaped bolts and nuts. More specifically, the fastener-receiving cavity 8 comprises a plurality of internal sidewalls designed to delineate a profile complimentary to the tool, bolt, or nut designed to be tightened by the present invention. The number within the plurality of internal sidewalls is subject to change; for example, in one embodiment, the number within the plurality of internal sidewalls is twelve. Although, alternative number of sidewalls may be utilized by the present invention. Additionally, various engagement features may be implemented within the plurality of internal sidewalls which provide additional gripping points for transfer of torque. In general, the size, shape, and depth of the fastener-receiving cavity 8 may vary to accommodate a variety of different fasteners. The fastener-receiving cavity 8 is positioned collinear with the rotation axis 11 of the spur gear 9 in order to efficiently transfer torque from the spur gear 9 to the external object. Referring to FIG. 3, the torque-transferring portion 7 is also laterally offset from the proximal base 16 in order to provide clearance for the plurality of drive pins 17. In one embodiment of the present invention, the engagement body 6 is magnetized to a certain degree for additional hold between the engagement body 6 and any attached tool or fastener. In general, the engagement body 6 can be designed to receive and hold various implements including, but not limited to, through sockets, male socket drivers, fasteners driver bit attachments, ratcheting attachments, and drill chuck attachments to name a few non-limiting examples.

In another embodiment of the present invention, the engagement body 6 is similar to a drill bit, wherein the fastener-receiving cavity 8 is replaced with a drive bit. The drive bit is adjacently connected to the torque-transferring portion 7 with a central axis of the drive bit being positioned collinear with the rotation axis 11 of the spur gear 9. This embodiment is designed for fasteners such as screws and other fasteners with slotted engagement heads. The cross section and shape of the drive bit may vary to accommodate a variety of fastener designs.

The present invention is attached to the external power tool through an attachment body 23 and an engagement bore 24, similar to traditional tools. The attachment body 23 is a cylindrical extrusion that is positioned opposite to the plurality of drive pins 17, across the drive shaft 12. Additionally, the attachment body 23 is terminally connected to the drive shaft 12. The engagement bore 24 receives the external power tool to allow the external power tool to rotate the drive shaft 12 and therefore rotate the engagement body 6. More specifically, the engagement bore 24 traverses into the attachment body 23, opposite the drive shaft 12. Additionally, in order to ensure that the drive train of the present invention is balanced, the engagement bore 24 is positioned collinear with the rotation axis 15 of the drive shaft 12. The shape, width, height, and depth of the engagement bore 24 may vary in order to be compatible with a variety of external power tools. In the preferred embodiment of the present invention, the engagement bore 24 has a rectangular shape with either a quarter of an inch width or three eights of an inch width as these sizes are the most common coupling bits on today's market. In an alternative embodiment of the present invention, the external surface of the attachment body 23 may be used as the mating element for the external power tool. For example, the external surface may be hexagonal in shaped.

In one embodiment, the present invention also utilizes a clutch-type mechanism in order to limit the amount of torque applied to the external object, thus preventing over tightening as well as prevent the engagement body 6 from stripping the head of the external object. The clutch-type mechanism comprises a recoiling mechanism 25 and a toothed clutch coupling 27. In this embodiment, the drive shaft 12 comprises a front shaft 13 and a rear shaft 14. The front shaft 13 is positioned adjacent to the ratchet head 2 and is rotatably attached within the tubular handle 3. The rear shaft 14 received the torque from the external power source and passes said torque to the front shaft 13. Thus, the rear shaft 14 is positioned adjacent to the front shaft 13, opposite to the ratchet head 2. Additionally, the rear shaft 14 is rotatably and slidably attached within the tubular handle 3. The rear shaft 14 is slidably attached within the tubular handle 3 in order to allow the rear shaft 14 to engage and disengage the front shaft 13 under specific circumstances through the toothed clutch coupling 27, i.e. the magnitude of torque being passed through the drive shaft 12. Thus, the toothed clutch coupling 27 is mechanically integrated in between the front shaft 13 and the rear shaft 14. The toothed clutch coupling 27 may be positioned into two states, an engaged state and a disengaged state. In the engaged state, the rear shaft 14 is mechanically connected to the front shaft 13, thus allowing torque to be transferred between the rear shaft 14 and the front shaft 13. In the disengaged state, the rear shaft 14 is able spin relative to the front shaft 13, thus no torque is transferred from the rear shaft 14 to the front shaft 13.

The recoiling mechanism 25 continuously applies a force onto the rear shaft 14 which pushes the rear shaft 14 into the front shaft 13, forcing the toothed clutch coupling 27 into the engaged state. In particular, the recoiling mechanism 25 is operatively coupled between the rear shaft 14 and the tubular handle 3, wherein the recoiling mechanism 25 is used to bias the rear shaft 14 towards the front shaft 13. As a result, the toothed clutch coupling 27 is in the engaged state by default and becomes disengages only when the torque difference between the rear shaft 14 and the front shaft 13 reaches a specific limit. In particular, when the torque difference between the front shaft 13 and the rear shaft 14 reaches the specific limit, the toothed clutch coupling 27 slips and allows the relative motion between the rear shaft 14 and the front shaft 13. This ensures that the external object does not experience a high magnitude of torque as this can lead damage the external object; i.e. stripping of the external object.

One type of recoiling mechanism 25 comprises a compression spring 26. The compression spring 26 is concentrically positioned about the rear shaft 14, within the tubular handle 3. A first end 28 of the compression spring 26 is connected to the rear shaft 14, adjacent to the front shaft 13. The second end 29 of the compression spring 26 is terminally connected to the tubular handle 3, opposite the ratchet head 2. As a result, the compression spring 26 applies an axial force onto the rear shaft 14 that pushes the rear shaft 14 into the front shaft 13, thus engaging the toothed clutch coupling 27.

In this embodiment of the present invention, the front shaft 13 and the rear shaft 14 are rotatably mounted within the tubular handle 3 through a first bearing 21 and a second bearing 22. More specifically, the first bearing 21 is concentrically mounted about the front shaft 13, within the tubular handle 3. Additionally, the first bearing 21 is positioned adjacent to the proximal base 16. Resultantly, the front shaft 13 is rotatably attached to the tubular handle 3 by the first bearing 21, thus allowing the front shaft 13 to rotate freely relative to the tubular handle 3. In a similar fashion, the second bearing 22 is concentrically mounted about the rear shaft 14 within the tubular handle 3. The second bearing 22 is positioned in between the front shaft 13 and the recoiling mechanism 25. Resultantly, the rear shaft 14 is rotatably mounted to the tubular handle 3 by the second bearing 22, thus allowing the rear shaft 14 to rotate freely relative to the tubular handle 3.

In one embodiment of the present invention, the drive shaft 13 is internally motorized. More specifically, an electric or a pneumatic motor is internally mounted within the tool housing. Additionally, the electric or pneumatic motor is torsionally connected to the drive shaft 13 in order to rotate the drive shaft 13 and power the present invention.

Although the invention has been explained in relation to its preferred embodiment, it is to be understood that many other possible modifications and variations can be made without departing from the spirit and scope of the invention as hereinafter claimed.

What is claimed is:

1. A power driven direct drive ratchet/wrench tool comprising: a tool housing; a spur gear; a drive shaft; a plurality of drive pins; an engagement body; the tool housing comprising a head, a tubular handle and a gear-receiving cavity; the head being terminally connected to the tubular handle; the tubular handle comprising a lumen; the gear-receiving cavity laterally traversing into the head; the gear-receiving cavity intersecting a the lumen; the gear-receiving cavity being oriented perpendicular to the tubular handle; the spur gear being rotatably mounted within the gear-receiving cavity; the spur gear being rotatable about a first rotation axis; the drive shaft being concentrically and rotatably mounted within the tubular handle; the drive shaft being rotatable about a second rotation axis; the first rotation axis and the second rotation axis being oriented perpendicular to each other; the plurality of drive pins being radially distributed around a-the second rotation axis; the drive shaft comprising a proximal base; each of the plurality of drive pins being perpendicularly connected to a the proximal base; at least one arbitrary pin among the plurality of drive pins being mechanically engaged to the spur gear; the engagement body being concentrically connected to the spur gear; the engagement body comprising a torque-transferring portion and a fastener-receiving cavity; the torque-transferring portion being laterally offset from the proximal base; the fastener-receiving cavity being collinear with the first rotation axis; the fastener-receiving cavity laterally traversing through the torque-transferring portion and the spur gear; the spur gear comprising a first face; the first face being positioned coincident with the second rotation axis; and the torque-transferring portion being connected onto the first face.

2. The power driven direct drive ratchet/wrench tool as claimed in claim 1 comprising: a recoiling mechanism; a toothed clutch coupling; the drive shaft comprising a front shaft and a rear shaft; the front shaft being positioned adjacent to the head; the front shaft being rotatably attached within the tubular handle; the rear shaft being positioned adjacent to the front shaft; opposite the head; the rear shaft being rotatably and slidably mounted within the tubular handle; the toothed clutch coupling being mechanically integrated in between the front shaft and the rear shaft; and the recoiling mechanism being operatively coupled between the rear shaft and the tubular handle, wherein the recoiling mechanism is used to bias the rear shaft towards the front shaft.

3. The power driven direct drive ratchet/wrench tool as claimed in claim 2 comprising: the recoiling mechanism comprising a compression spring; the compression spring being concentrically positioned about the rear shaft, within the tubular handle; a first end of the compression spring being connected to the rear shaft, adjacent to the front shaft;

and a second end of the compression spring being terminally connected to the tubular handle, opposite the head.

4. The power driven direct drive ratchet/wrench tool as claimed in claim 2 comprising:

a first bearing;

a second bearing;

the first bearing being concentrically mounted about the front shaft within the tubular handle;

the first bearing being positioned adjacent to the proximal base;

the front shaft being rotatably mounted to the tubular handle by the first bearing;

the second bearing being concentrically mounted about the rear shaft within the tubular handle;

the second bearing being positioned in between the front shaft and a recoiling mechanism; and the rear shaft being rotatably mounted to the tubular handle by the second bearing.

5. The power driven direct drive ratchet/wrench tool as claimed in claim 1 comprising:

an attachment body;

an engagement bore;

the attachment body being positioned opposite to the plurality of drive pins, across the drive shaft;

the attachment body being terminally connected to the drive shaft;

the engagement bore traversing into the attachment body, opposite the drive shaft; and the engagement bore being collinear with the second rotation axis.

6. The power driven direct drive ratchet/wrench tool as claimed in claim 1, wherein the engagement body is magnetized.

7. The power driven direct drive ratchet/wrench tool as claimed in claim 1 comprising:

each of the plurality of drive pins comprising a fixed end, a tooth body and a free end;

the tooth body being connected in between the fixed end and the free end;

the fixed end being connected onto the proximal base; and the tooth body tapering from the fixed end to the free end.

8. The power driven direct drive ratchet/wrench tool as claimed in claim 1, wherein each of the plurality of drive pins is truncated conical shape.

* * * * *